US008020895B2

(12) United States Patent
Reichmuth

(10) Patent No.: US 8,020,895 B2
(45) Date of Patent: Sep. 20, 2011

(54) DEVICE COMPRISING AN OUTFLOW BEND AND A PIPE CLAMP AND MOUNTING STRUCTURE COMPRISING SUCH A DEVICE

(75) Inventor: Peter Reichmuth, Wolfhausen (CH)

(73) Assignee: Geberit Technik AG, Jona (CH)

( * ) Notice: Subject to any disclaimer, the term of this patent is extended or adjusted under 35 U.S.C. 154(b) by 213 days.

(21) Appl. No.: 12/339,562

(22) Filed: Dec. 19, 2008

(65) Prior Publication Data

US 2009/0160181 A1 Jun. 25, 2009

(30) Foreign Application Priority Data

Dec. 21, 2007 (EP) ..... 07405366

(51) Int. Cl.
*F16L 3/00* (2006.01)

(52) U.S. Cl. ..... 285/64; 285/180; 248/73

(58) Field of Classification Search ..... 285/64, 285/24, 61, 56, 180; 248/57, 70, 73, 74.1, 248/74.4, 72, 71
See application file for complete search history.

(56) References Cited

U.S. PATENT DOCUMENTS

| | | | | | |
|---|---|---|---|---|---|
| 3,014,223 | A | * | 12/1961 | Pope | 285/64 |
| 3,226,069 | A | * | 12/1965 | Clarke | 248/73 |
| 4,638,829 | A | * | 1/1987 | Cornwall | 285/64 |
| 4,886,426 | A | * | 12/1989 | Surinak | 285/24 |
| 4,907,766 | A | * | 3/1990 | Rinderer | 248/74.1 |

FOREIGN PATENT DOCUMENTS

| | | | |
|---|---|---|---|
| DE | 94 03 872.4 | U1 | 5/1994 |
| DE | 298 05 841 | U1 | 5/1998 |
| DE | 20 2004 017 027 | U1 | 3/2006 |
| EP | 0 733 842 | A1 | 9/1996 |
| EP | 0 978 595 | A2 | 2/2000 |
| GB | 2 134 611 | A | 8/1984 |

* cited by examiner

*Primary Examiner* — David E Bochna
(74) *Attorney, Agent, or Firm* — Sughrue Mion, PLLC

(57) ABSTRACT

The device serves to fasten the outflow bend (9) to a fastening body (4), for example to a mounting frame (2). The pipe clamp (11) has a holder (12), which on an inner side (20) possesses grooves (21), which, for the axial fixing of the socket (10), cooperate with ribs (22, 23, 24) on an outer side of the socket (10). The holder (12) has a collar (19), which, for the axial fixing of the socket (10), can be mounted into a groove (25, 26) of the socket (10) or onto a rib (22, 23, 24) of the socket (10), according to choice.

17 Claims, 3 Drawing Sheets

DEVICE COMPRISING AN OUTFLOW BEND AND A PIPE CLAMP AND MOUNTING STRUCTURE COMPRISING SUCH A DEVICE

BACKGROUND OF THE INVENTION

The invention relates to a device comprising an outflow bend having a socket for the reception of a pipe end or connecting branch, and a pipe clamp for fastening the outflow bend to a fastening body, for example to a mounting frame, the pipe clamp having a holder which on an inner side has ribs and grooves, which, for the axial fixing of the socket, cooperate with grooves and ribs on an outer side of the socket.

The invention also relates to a mounting structure comprising such a device.

Devices of this type serve, for example, and in particular, to connect a toilet bowl or some other sanitary body to a waste disposal conduit. The outflow bend is here fastened by the pipe connecting branch, for example to a cross member of the mounting frame. The toilet bowl is then likewise fastened to the frame, the outflow connecting branch being inserted into the socket in a seal-tight manner. It is here important that the socket or the outflow bend is fixed precisely in a certain axial position on the mounting frame. If the socket is not exactly positioned, then the toilet bowl cannot be fitted in the intended position and/or the connection to the socket is not seal-tight.

EP-A-0 978 595 has disclosed an outflow bend possessing a socket which on the outer side has a plurality of outwardly directed webs and, between these, grooves. For the fastening of the pipe, a special pipe clamp is provided, which likewise has a plurality of grooves and ribs. This arrangement makes it possible to adjust to different axial spacings for the mounting of the pipe and/or the sanitary element. However, only very few positions are possible here, so that the range of axial adjustment is very limited and a comparatively fine positioning is not possible. Moreover, no commercially available outflow bend can herewith be fastened using a standard pipe clamp.

EP-A-0 733 842 has disclosed a pipe clamp having a holder and a band-shaped connecting element. The holder is fastened to a fastening body, which is configured as a plate and has a plurality of apertures arranged in a row, so that the holder can be latched onto this fastening body in different axial positions. The device requires a corresponding special fastening body. The positioning, in accordance with the spacings of these apertures, is comparatively crude.

BRIEF SUMMARY OF THE INVENTION

The object of the invention is to provide a device of the said type, which device allows a finer adjustment within a greater range. The device is intended, however, to be easy to fit and functionally reliable.

In a device of the generic type, the object is achieved by the fact that the holder has a collar, which, for the axial fixing of the socket, can be mounted into a groove of the socket or onto a rib of the socket, according to choice. With just two grooves and three ribs on the socket and two grooves on the collar, six different axial positions are already obtained. Both the socket and the holder or collar are very easy to produce, since both the said grooves and ribs can be very easily produced from a manufacturing aspect.

According to one refinement of the invention, it is provided that the holder has a base, which possesses fastening means by which the pipe clamp can be fastened in at least one opening of the fastening part. In particular, it is provided that the holder has at least one latching element. The pipe clamp can then be latched, for example, onto a cross member of a mounting frame.

According to one refinement of the invention, it is provided that the said latching means or fastening means of the holder have at least one hook and a latching tongue. The holder is hung by the hook from a cross member, for example, and is then pivoted such that the latching tongue engages, for example, in an opening. This allows a simple and stable, and also detachable fastening of the holder. Preferably, the base is of plate-like configuration. The fastening means are preferably fastened to the bottom side of the plate. The holder can then be fastened such that the said collar projects upwards and thus the socket can be mounted onto the holder from above.

The invention also relates to a mounting structure comprising such a device and having a frame to which the outflow bend is fastened by the pipe clamp. The pipe clamp possesses a clip placed around the socket of the pipe bend. The holder can be fastened, in the axial direction of the socket, in different positions on the frame. This allows, in particular, a first crude adjustment of the axial position of the socket or of the outflow bend. The fine adjustment, or at least a finer adjustment, is then possible with the connection between the collar and the socket. This allows a particularly fine adjustment within a comparatively large axial range.

According to one refinement of the invention, it is provided that on the frame at least two slots are arranged, in which the holder can be fastened in different axial positions. In particular, these slots are arranged respectively in pairs. The invention also relates to a pipe clamp for the said device and an outflow bend for a mounting device.

Further advantageous features derive from the dependent patent claims, the following description and the drawing.

BRIEF DESCRIPTION OF THE DRAWINGS

An illustrative embodiment of the invention is explained in greater detail below with reference to the drawing, wherein.

DETAILED DESCRIPTION OF THE INVENTION

Figure 1:
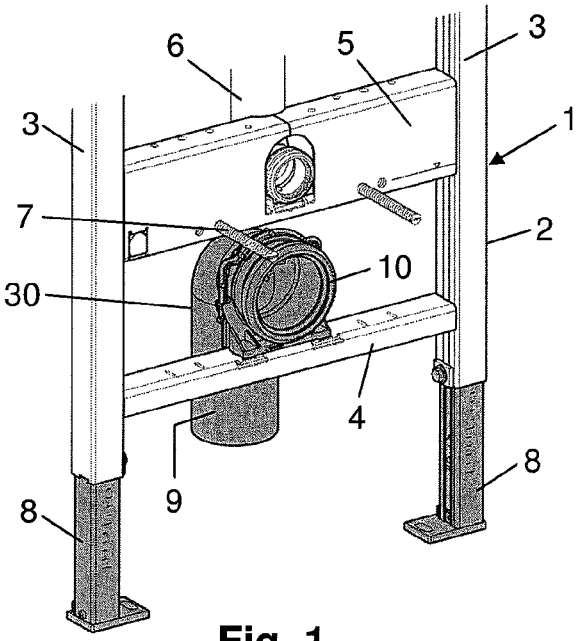
FIG. 1 shows schematically a three-dimensional view of a mounting structure according to the invention.

The mounting device 1 shown in FIG. 1 possesses a frame 2 having two vertical stays 3, which respectively at a bottom end possess telescopically extensible feet 8. These feet 8 are fastenable to the floor of a building (not shown here). The frame 2 also possesses a cross member 4, for example made of a sheet-metal profile, which joins together the two stays 3. Located above the cross member 4 is a mounting plate 5, which likewise extends horizontally and joins together the two stays 3. The plate 5 serves for the fastening of a sanitary article (not shown here), for example a toilet bowl, and possesses for this purpose two mutually spaced threaded rods 7. On the plate 5 there is also mounted a flush pipe 6, which is connected to a cistern (not shown here).

Figure 2:
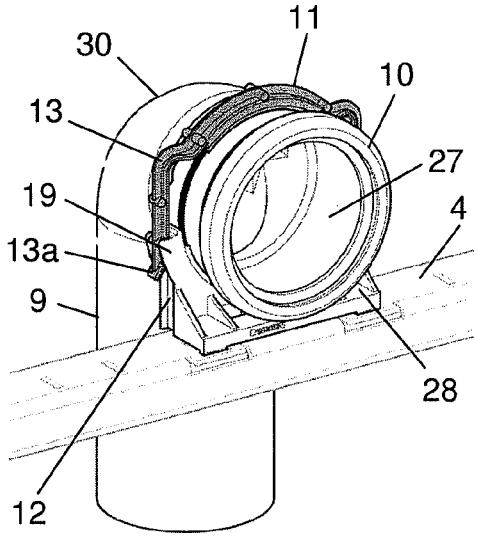
FIG. 2 shows schematically a three-dimensional view of a device according to the invention having an outflow bend and a pipe clamp.

Fastened on the cross member 4 is a device 30, consisting of an outflow bend 9 and a pipe clamp 11, as shown by FIG. 2. The outflow bend 9 possesses a socket 10, which, for the reception of a pipe end or an outflow connecting branch of a sanitary article, has an opening 27. In the fitting of the sanitary article, this outflow connecting branch or the pipe end is inserted into this opening 27 of the socket 10. With sealing means (not shown here), this pipe end or the outflow connecting branch can then be connected in a seal-tight manner to the socket 10.

The pipe clamp 11 consists of a holder 12 and a clip 13 detachably connected thereto. The clip 13 possesses two ends 13*a*, which are respectively inserted from above into openings 14 (FIG. 5*a*) of a roughly semi-circular collar 19 of the holder 12. These ends 13*a* can be latch-locked, for example, in these openings 14. Other connections are here also conceivable, however. The clip 13 can also be configured, for example, as a flexible band or the like. According to FIG. 2, it rests on top of the socket 10 and connects this detachably to the holder 12.

Figure 4A:
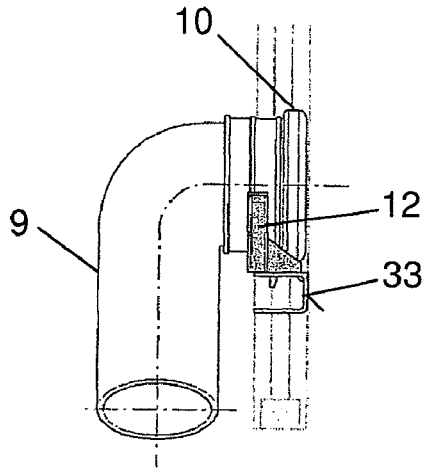
Figure 4B:
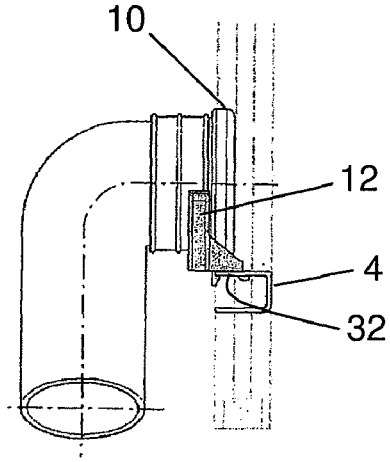
Figure 5A:
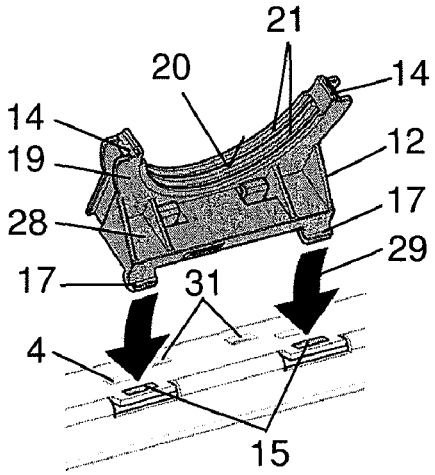
Figure 5B:
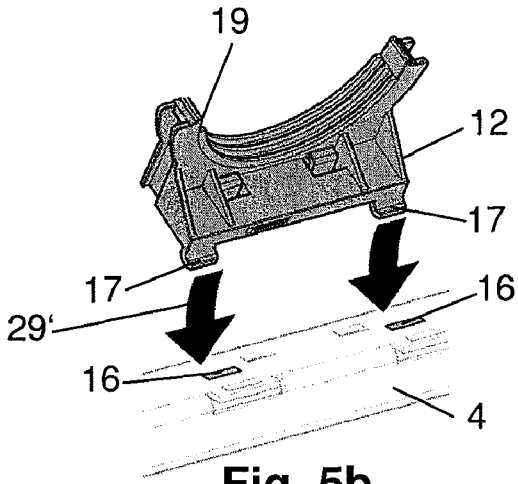

The holder 12 possesses a plate-like base 28, onto which the collar 19 is formed. Onto a bottom side of the plate-like base 28 there are formed, for example, according to FIGS. 5*a* and 5*b*, two mutually spaced hooks 17. According to FIG. 5*a*, these hooks 17 can be inserted into slots 15 on the top side of the cross member 4, as is shown in FIG. 5*a* with arrows 29. Optionally, according to FIG. 5*b*, these hooks 17 can also however be inserted into slots 16, which, at a distance from the slots 15, are likewise recessed into the top side of the cross member 4. If the hooks 17 are inserted in the slots 15 or 16, then the angled base 28 is pivoted into the horizontal position, whereupon latching tongues 18 engage in further slots 31 of the cross member 4 and thereby fix the holder 12 on the cross member 4. If the holder 12 according to FIG. 5*b* is mounted in the direction of the arrows 29', then the latching tongues 18 engage on a rear edge 32 of the cross member 4, as is shown in FIG. 4*b*. FIG. 4*a* shows the position of the holder 12 when this, according to FIG. 5*a*, is mounted on the cross member 4. FIG. 4*b*, on the other hand, shows the holder 12 in the position in which it has a greater distance from a front side 33 of the cross member 4. The holder 12 according to FIG. 4*b* has been fitted according to FIG. 5*b*. For the holder 12 there are thus two different axial positions on the cross member 4. The hooks 17 and the latching tongues 18 are here merely examples of suitable fastening means. Other mechanical fastening means are here also conceivable, however, in particular plug connections which allow different positions. It is conceivable, for example, for the slots to be arranged on the base 28 and the corresponding hooks and latching tongues on the cross member 4.

Figure 6:
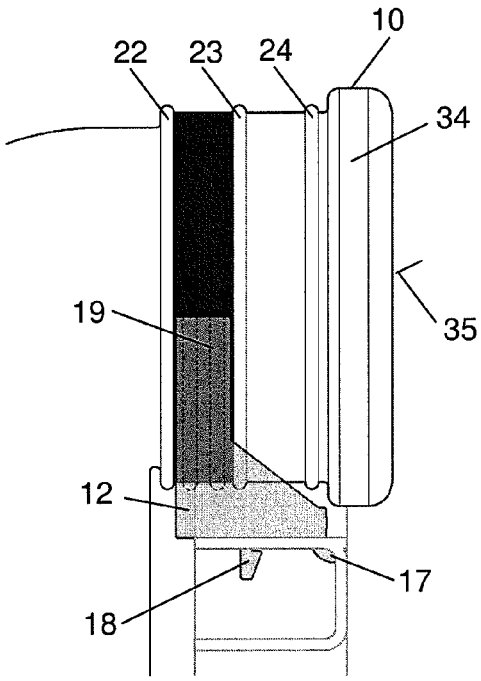
FIG. 6 shows schematically the fastening of a socket, the collar engaging in a groove of the socket.
Figure 7:
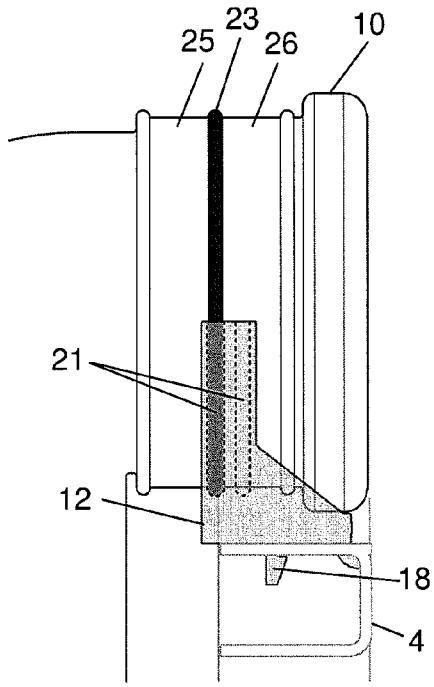
FIG. 7 shows a view according to FIG. 6, the collar being mounted on a rib of the socket.

The socket 10 possesses a circumferential bead 34 having a front side 35. Behind this bead, the socket 10 possesses three circumferential ribs 22, 23 and 24 and, between these, comparatively wide grooves 25 and 26. The width of the ribs 22, 23 and 24 is preferably equal and is many times smaller than the width of the grooves 25 and 26, as is clearly shown, for example, by FIGS. 6 and 7. The collar 19 possesses according to FIG. 5*a* an inner side 20, which is of roughly semi-circular configuration and has two mutually spaced grooves 21. These grooves 21 are of corresponding configuration to the grooves 22, 23 and 24. These grooves 21 can thus respectively receive one of the ribs 22, 23 and 24, substantially without axial tolerance.

Figure 3A:
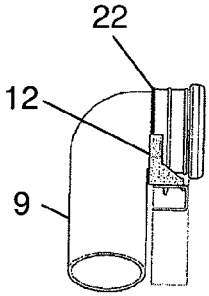
FIG. 3*a*-3*f* show schematically different fastening options of the outflow bend to the pipe clamp, FIGS. 4*a*+4*b* show schematically the fastening of an outflow bend on a cross member, FIGS. 5*a*+5*b* show schematically the fastening of a holder on a cross member.
Figure 3B:
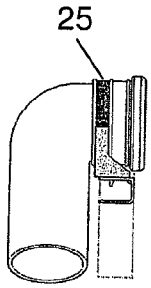
Figure 3C:
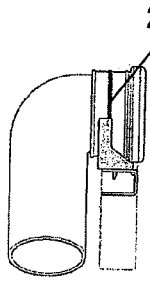
Figure 3D:
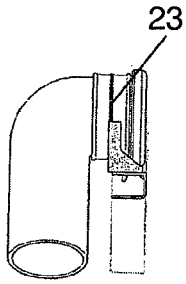
Figure 3E:
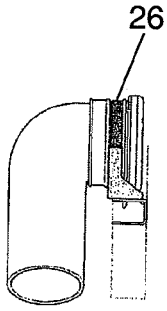
Figure 3F:
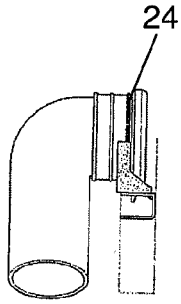
Figure 8:
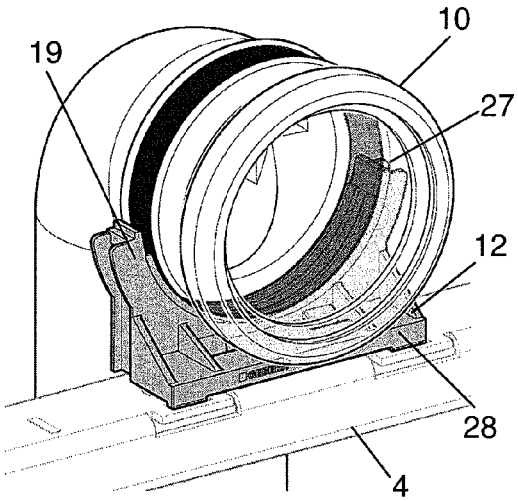
FIG. 8 shows the fastening according to FIG. 6, but in three-dimensional representation.
Figure 9:
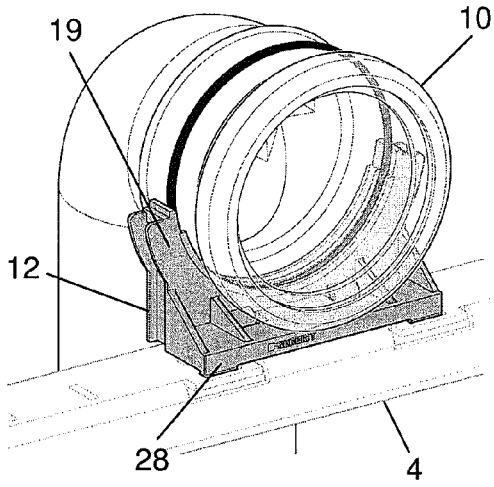
FIG. 9 shows the fastening according to FIG. 7, but here too in three-dimensional representation.

The collar 19 possesses a width which corresponds to the width of the groove 25 or groove 26. The collar 19 can engage over the whole of its length, on the inner side 20, in the groove 25 or in the groove 26, according to choice. The socket 10 can thus be mounted onto the holder 12 in two different axial positions. In one position, the collar 19 engages according to FIG. 6 in the groove 25. In the other position, the collar 19 engages, on the other hand, in the groove 26. These two positions are shown in FIGS. 3*b* and 3*e*. The position according to FIG. 3*b* corresponds, moreover, to the position according to FIG. 8. The socket 10 can also, however, be mounted onto the holder 12 such that one of the ribs 22, 23 and 24 engages in one of the grooves 21 of the holder 19. The possible positions are shown in FIGS. 3*a*, 3*c*, 3*d* and 3*f*. The position according to FIG. 3*d* corresponds to the position shown in FIGS. 7 and 9. Numerous axial positions of the socket 10 or of the outflow bend 9 are thus possible here. The bead 34 can thus project over the front side 33 of the cross member 4 and be flush with the front side 35, or be arranged behind the front side 33. The axial positions according to FIG. 3*a* to 3*f* differ by just a few millimetres. These positions thus allow a fine positioning of the socket 10 on the cross member 4. That positioning of the holder 12 on the cross member 4 which is shown with reference to FIG. 5*a* and 5*b* allows, on the other hand, a comparatively crude axial positioning. Since the positions according to FIG. 3*a* to 3*f* can respectively be combined with the position according to FIG. 5*a* or 5*b*, according to choice, twelve possible axial positions are thus finally obtained. Instead of the said two positions on the cross member 4, more than two positions are here also conceivable, however. Likewise, the positions stated in FIG. 3*a* to 3*f* can also be less or greater.

The assembly process for fastening the outflow bend 9 to the frame 2 is explained in greater detail below.

First, the frame 2 is fastened in a manner which is known per se, for example in a front-wall assembly in front of a building wall. In principle, a fastening of the frame 2 in a wall, and thus in concealed mounting, is here also possible, however. The frame 2 can here, however, also be another suitable fastening device which allows a lavatory bowl, for example, to be fitted. The holder 12 is now fastened to the cross member 4 in one of the aforementioned two positions. This fastening can be made without tools, since the holder 12 is latched on. The outflow bend 30 pre-fitted on the waste disposal conduit is now mounted into the holder 12, one of the positions shown in FIG. 3*a* to 3*f* being chosen. Finally, the clip 13 is mounted. The outflow bend 9 is now connected in the desired position to the cross member 4 or the frame 2, in a stress-free and fixed manner. The sanitary body can now be fastened to the frame 2, the pipe connecting branch being inserted in the socket 10 and thus connected to the outflow bend 30 or to the waste disposal conduit (not shown here). The flush pipe 6 is connected to the sanitary body in a known manner.

REFERENCE SYMBOL LIST

| | |
|---|---|
| 1 | mounting device |
| 2 | frame |
| 3 | stay |
| 4 | cross member |
| 5 | mounting plate |

-continued

| | |
|---|---|
| 6 | flush pipe |
| 7 | threaded rod |
| 8 | foot |
| 9 | outflow bend |
| 10 | socket |
| 11 | pipe clamp |
| 12 | holder |
| 13 | clip |
| 13a | end |
| 14 | plug-in opening |
| 15 | front plug-in openings |
| 16 | rear plug-in opening |
| 17 | hook |
| 18 | latching tongue |
| 19 | collar |
| 20 | inner side |
| 21 | groove |
| 22 | first rib |
| 23 | second rib |
| 24 | third rib |
| 25 | first groove |
| 26 | second groove |
| 27 | opening |
| 28 | base |
| 29 | arrow |
| 30 | device |
| 31 | slots |
| 32 | edge |
| 33 | front side |
| 34 | bead |
| 35 | front side |

The invention claimed is:

1. A device comprising an outflow bend having a socket for the reception of a pipe end or connecting branch, and a pipe clamp for fastening the outflow bend to a fastening body, the pipe clamp having a holder with a collar, wherein the collar on an inner side has grooves, which, for the axial fixing of the socket, cooperate with ribs on an outer side of the socket, wherein the collar, for the axial fixing of the socket, can be mounted into a groove of the socket or onto a rib of the socket, according to choice, wherein the holder has a base, which possesses fastening means by which the pipe clamp can be fastened in at least one opening of the fastening body, and wherein the fastening means have at least one hook and, at a distance from the at least one hook, a latching tongue.

2. The device according to claim 1, wherein the base is of plate-like configuration.

3. A pipe clamp of a device according to claim 1, wherein it has on a base fastening means for fastening the holder to a mounting frame, and the collar has on an inner side fastening means for fastening the socket to the holder.

4. The pipe clamp according to claim 3, wherein the collar has on the said inner side at least two grooves for receiving a rib of the socket.

5. An outflow bend for a device according to claim 1, wherein it has in the region of the socket, on an outer side, at least two circumferential grooves and at least two circumferential ribs, the grooves respectively having a width which is many times greater than a width of one of the ribs.

6. The outflow bend according to claim 5, wherein the grooves correspond to the dimensions of standard pipe clamps.

7. A mounting structure comprising:

a device having an outflow bend having a socket for the reception of a pipe end or connecting branch, and a pipe clamp for fastening the outflow bend to a fastening body, the pipe clamp having a holder with a collar, wherein the collar on an inner side has grooves, which, for the axial fixing of the socket, cooperate with ribs on an outer side of the socket, wherein the collar, for the axial fixing of the socket, can be mounted into a groove of the socket or onto a rib of the socket, according to choice, and having a frame, to which the outflow bend is fastened by the pipe clamp, the pipe clamp having a clip placed around the socket of the outflow bend, characterized in that the pipe bend can be fastened, in the axial direction of the socket, in different positions on the frame.

8. The mounting structure according to claim 7, wherein the frame, for the crude positioning of the outflow bend, has at least two fastening means, which are spaced apart in the axial direction of the fitted socket.

9. The mounting structure according to claim 7, wherein the fastening means of the frame are slots, into which fastening parts of the base are insertable.

10. The mounting structure according to claim 7, wherein the pipe clamp can be crudely positioned on the frame for the depth adjustment of the outflow bend, and in that the socket can be finely positioned on the pipe clamp.

11. The mounting structure according to claim 7, wherein the socket of the outflow bend can be finely positioned on the collar.

12. The mounting structure according to claim 7, wherein the socket has on the outer side at least two ribs and at least two grooves, and in that the collar has on the inner side at least two grooves, corresponding to the said ribs, and in that the collar can be placed in one of the two grooves or on one of the two ribs of the socket, according to choice.

13. The mounting structure according to claim 7, wherein the collar has a width which substantially corresponds to the widths of the two grooves of the socket.

14. The mounting structure according to claim 7, wherein the collar has two mutually parallel running grooves, and in that the distance between these two grooves is substantially smaller than the widths of the grooves of the socket.

15. A device comprising an outflow bend having a socket for the reception of a pipe end or connecting branch, and a pipe clamp for fastening the outflow bend to a fastening body, the pipe clamp having a holder with a collar, wherein the collar on an inner side has grooves, which, for the axial fixing of the socket, cooperate with ribs on an outer side of the socket, wherein the collar, for the axial fixing of the socket, can be mounted into a groove of the socket or onto a rib of the socket, according to choice, wherein it has on a base fastening means for fastening the holder to a mounting frame, and the collar has on an inner side fastening means for fastening the socket to the holder, and wherein the holder has on a bottom side at least one hook for its fastening.

16. A device comprising an outflow bend having a socket for the reception of a pipe end or connecting branch, and a pipe clamp for fastening the outflow bend to a fastening body, the pipe clamp having a holder with a collar, wherein the collar on an inner side has grooves, which, for the axial fixing of the socket, cooperate with ribs on an outer side of the socket, wherein the collar, for the axial fixing of the socket, can be mounted into a groove of the socket or onto a rib of the socket, according to choice, wherein it has on a base fastening means for fastening the holder to a mounting frame, and the collar has on an inner side fastening means for fastening the socket to the holder, and, wherein the holder has on a bottom side at least one latching tongue for its fastening.

17. A device comprising an outflow bend having a socket for the reception of a pipe end or connecting branch, and a pipe clamp for fastening the outflow bend to a fastening body, the pipe clamp having a holder with a collar, wherein the collar on an inner side has grooves, which, for the axial fixing of the socket, cooperate with ribs on an outer side of the socket, wherein the collar, for the axial fixing of the socket, can be mounted into a groove of the socket or onto a rib of the socket, according to choice, wherein the holder has a base, which possesses fastening means by which the pipe clamp can be fastened in at least one opening of the fastening body, wherein the fastening means have at least one latching element, and wherein the fastening means have at least one hook and, at a distance from the latter, a latching tongue.

* * * * *